US009945612B2

(12) United States Patent
Lundberg et al.

(10) Patent No.: US 9,945,612 B2
(45) Date of Patent: Apr. 17, 2018

(54) SYSTEM AND METHOD TO REMOVE MOISTURE FROM WOOD CORING

(75) Inventors: David Lundberg, Fort Lauderdale, FL (US); Jon Bartnick, Wyoming, MI (US)

(73) Assignee: Dryboat South, LLC, Fort Lauderdale, FL (US)

( * ) Notice: Subject to any disclaimer, the term of this patent is extended or adjusted under 35 U.S.C. 154(b) by 1313 days.

(21) Appl. No.: 12/830,336

(22) Filed: Jul. 4, 2010

(65) Prior Publication Data

US 2011/0010960 A1 Jan. 20, 2011

Related U.S. Application Data

(63) Continuation-in-part of application No. 11/686,129, filed on Mar. 14, 2007, now abandoned.

(51) Int. Cl.
*F26B 21/00* (2006.01)
*B63B 9/00* (2006.01)

(52) U.S. Cl.
CPC ..... *F26B 21/006* (2013.01); *B63B 9/00* (2013.01); *B63B 2009/008* (2013.01); *F26B 2210/16* (2013.01)

(58) Field of Classification Search
CPC ..... F26B 21/006; F26B 2210/12; F26B 2210/14; F26B 2210/16; F26B 1/005; F26B 3/00; F26B 3/06; B63B 2009/00; B63B 2009/005; B63B 2009/008; B63B 13/00; B63B 13/02; B63B 9/00
USPC ..... 34/402, 406, 413, 437, 439, 443, 467, 34/487, 507, 72, 79, 80, 81, 418, 426; 118/355, 358, 82; 114/355, 358, 82
See application file for complete search history.

(56) References Cited

U.S. PATENT DOCUMENTS

| | | | | |
|---|---|---|---|---|
| 4,946,485 | A * | 8/1990 | Larsson | 96/152 |
| 5,155,924 | A * | 10/1992 | Smith | 34/443 |
| 5,893,216 | A * | 4/1999 | Smith et al. | 34/103 |
| 6,079,119 | A | 6/2000 | Magnusson | |
| 6,457,258 | B1 * | 10/2002 | Cressy et al. | 34/443 |
| 6,647,639 | B1 * | 11/2003 | Storrer | 34/443 |
| 6,691,427 | B1 | 2/2004 | Fernandes et al. | |

(Continued)

FOREIGN PATENT DOCUMENTS

FR 2821581 A1 * 9/2002 ..... B27K 5/00

OTHER PUBLICATIONS

"Rot Repair in Fiberglass Boats" <www.rotdoctor.com/glass/GLrotrepair.html>. Oct. 28, 2005. Accessed via <http://web.archive.org/web/20051028173922/http://www.rotdoctor.com/glass/GLrotrepair.html> Sep. 23, 2013.*

(Continued)

*Primary Examiner* — Jianying Atkisson
*Assistant Examiner* — Tavia Sullens
(74) *Attorney, Agent, or Firm* — Mitchell Intellectual Property Law, PLLC

(57) ABSTRACT

A system and process is provided to deplete or remove moisture from wood coring in boats by piercing 20 a fiberglass outer skin; forming 30 bores or holes 200 in wood coring to form an exposed portion; processing ambient air 35 to create processed air; pumping or displacing 40 processed air into the bores or holes 200; penetrating 50 an exposed portion 80; with a sealant 100; and filling 60 the exposed portion 80 with a sealant 100.

20 Claims, 2 Drawing Sheets

(56) References Cited

U.S. PATENT DOCUMENTS

| | | | | |
|---|---|---|---|---|
| 6,886,271 | B2 | 5/2005 | Storrer | |
| 2005/0257394 | A1* | 11/2005 | Claesson | 34/92 |
| 2005/0271800 | A1* | 12/2005 | DeTurris | 427/140 |
| 2011/0010960 | A1 | 1/2011 | Lundberg et al. | |

OTHER PUBLICATIONS

English Machine Translation: FR 2821581: Accessed Mar. 11, 2014.*

Pioneer Air Systems: Compressed Air Systems Guide. 1990. <http://www.pioneerair.com/wp/wp-content/uploads/PDF-Brochures/Compressed_Air_Guide_Brochure.pdf>. Accessed Mar. 13, 2014.*

"Rot Repair in Fiberglass Boats" <www.rotdoctor.com/glass/GLrotrepair.html>. Oct. 28, 2005. Accessed via http:/web.archive.org/web/20051028173922/http://www.rotdoctor.com/glass/GLrotrepair.html> Sep. 23, 2013.

* cited by examiner

SYSTEM AND METHOD TO REMOVE MOISTURE FROM WOOD CORING

RELATED APPLICATIONS

This is a continuation in part application, and claims priority from application Ser. No. 11/686,129 filed Mar. 14, 2007, now abandoned.

BACKGROUND OF THE INVENTION

This invention relates to a system and method of drying wood structures, particularly those found in boats.

Boats may be comprised of wood coring in certain areas. The coring may be stringers 210, transoms 220, and bulkheads 230. Coring provides hull strength. The present invention may also be used on decks of a boat or house, and other wood. Wood coring can weigh less than fiberglass coring. Wood coring is usually coated with fiberglass, to form a fiberglass outer skin. However moisture can still enter the wood coring. When moisture enters the wood coring it can weaken the structural integrity of the wood coring. In some cases the wood coring becomes saturated, partially saturated, or moldy. The boat may then become too weak to operate safely in the water; or it may be a source of toxic mold or cause of other respiratory problems. Further, the boat may be un-insurable when moisture enters the coring. Thus the coring may have to be cut, or removed and then rebuilt.

U.S. Pat. No. 6,886,271 ("the '271 patent" or "the Storrer patent") discloses a system to remove water and moisture from hard wood flooring. This patent does not disclose hole creation or the drilling of holes to expose wood, and to remove moisture therefrom.

The process of the present invention is less destructive than the prior art. For example, U.S. Patent Publication No. 2005/0271800 ("the DeTurris application") removes coring by vacuuming, which causes distortion in the wood coring. It may not seem like a big deal but 0.1 of an inch can be thousands in filling, sanding and painting. The applicants' process at worst leaves ½ inch diameter holes that can easily be filled and finished.

DeTurris removes coring, whereas applicant does not remove coring. DeTurris uses a vacuum to pull air out, whereas applicant forces processed air in. During the vacuum process, it is possible that the wood can be deformed slightly, and with a fiberglass exterior, the interior deformation is highly visible when looking at the fiberglass exterior. Also, using a vacuum process pulls air to affected area, which can draw in unwanted debris.

DeTurris and Storer use ambient air as opposed to processing the air first, which is referred to herein as processed air.

The process of the prior art also tends to void the warranty of the boat due to the substantial structural changes.

As can be seen, there is a need for a system and method that removes moisture from wood coring. There is also a need for a system and method that does not require the removal and reconstruction of coring. There is also a need for a system and method to remove moisture from coring at a reduced cost, and with less down time of the boat. There is also a need for a system and method to apply a sealant, epoxy, or protectant that penetrates the wood; and to apply a sealant, epoxy, or protectant to fill holes in wood coring. There is also a need to remove moisture from wood coring without voiding the warranty of the manufacturer. There is also a need to use air that is processed to remove moisture, and then use this "processed air."

SUMMARY OF THE INVENTION

One aspect of a preferred embodiment of the present invention is a method of removing moisture from wood coring of a boat, comprising the steps of: piercing 20 a fiberglass outer skin; forming 30 bores or holes 200 in wood coring to form an exposed portion; processing ambient air 35 to create processed air; and pumping or displacing 40 said processed air into said bores or holes 200.

Another aspect of a preferred embodiment of the present invention is a method to remove moisture from wood coring of a boat, comprising: forming 30 bores or holes 200 in wood coring to form an exposed portion; processing ambient air 35 to create processed air; pumping or displacing 40 processed air into the bores or holes 200; penetrating 50 an exposed portion 80; with a sealant 100; and filling 60 the exposed portion 80 with a sealant 100.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, a preferred embodiment of the present invention may be used for removing moisture from wood by using processed air, not ambient air. Moisture includes liquid and water. One preferred embodiment of the present invention is of particular importance for use to remove moisture from the coring of boats.

One preferred embodiment of the present invention differs from the prior art by, among other things, the use of a method that removes moisture but does not require destruction and reconstruction of the coring. A preferred embodiment of the present invention also differs by not using ambient air, but processed air. Processed air is air in which moisture is removed. This document refers to air in which moisture is removed as "processed air" or "ultra-dry air."

A preferred embodiment of the present invention allows the structural integrity of the coring to remain, which (1) reduces the cost involved in removing the coring and reconstructing new coring; (2) reduces the time in which the boat is unavailable for use because of the time involved to remove and reconstruct coring.

Figure 1:
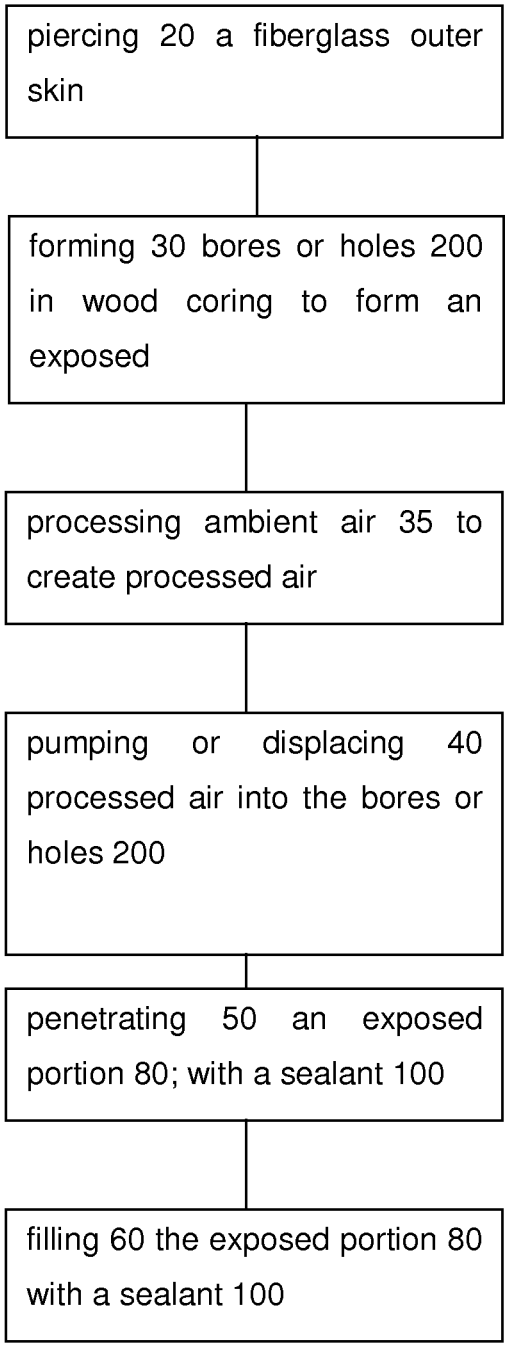
FIG. 1 is a schematic drawing showing the process steps used in an embodiment of a moisture removal system of the present invention.
Figure 2:
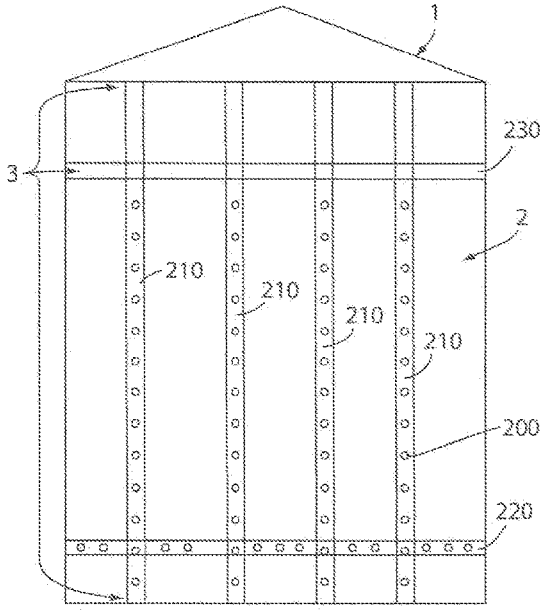
FIG. 2 is a plan view of the bottom of the hull 1 of a boat, showing its bottom 2 and coring 3.

FIG. 1 is a general schematic that illustrates an embodiment of a moisture removal system 10 of the present invention, including steps that may include:

1. piercing 20 a fiberglass outer skin;
2. forming 30 bores or holes 200 in wood coring to form an exposed portion;
3. processing ambient air 35 to create processed air;
4. pumping or displacing 40 processed air into the bores or holes 200;
5. penetrating 50 an exposed portion 80; with a sealant 100; and
6. filling 60 the exposed portion 80 with a sealant 100.

In one exemplary embodiment of the present invention, the piercing step 20 includes the forming 30 of bores or holes 200 that are spaced apart by a distance of about 8 inches. In one exemplary embodiment of the present invention, the holes 200 may have a diameter of about ½ of an inch. In one exemplary embodiment of the present invention, the holes 200 may have a diameter of about ¼ of an inch. The processing of ambient air 35 may include removing at least about 50% of the moisture from ambient air. The processing step 35 may employ the use of a desiccant to convert ambient air into processed air or ultra-dry air. The pumping or displacing 40 of dry air into the holes 200 may be performed by injection hoses that are adapted to fit the holes 200.

The holes 200 with the larger diameter, i.e. about ½ of an inch, may be used to receive injection hoses with a larger diameter; to displace or pump 40 more dry air that the injection hoses having a smaller diameter, such as about ¼ of an inch. In one exemplary embodiment, the forming 30 of bores or holes 200 can be created by drilling the bores or holes 200. In one exemplary embodiment, the spacing 70 of the bores or holes 200 may be greater than 8 inches. In one exemplary embodiment, the spacing 70 of the bores or holes 200 may be less than 8 inches. In one exemplary embodiment, the spacing 70 of the bores or holes 200 may vary. The forming 30 of bores or holes 200 creates an exposed portion 80 of the coring. In one exemplary embodiment the holes 200 are about 95% of the length of the wood in which the hole 200 may be in. For example, if a hole 200 is formed in a stringer, and the stringer is 100 inches long, the hole 200 may be 95 inches long. In one exemplary embodiment of the present invention, the dry air may be displaced or pumped 40 through the holes 200 at a rate of about 100 cubic feet per minute. Sometimes, it may take up to about 9 days to dry the coring, with use a preferred embodiment of the present invention.

The pumping step 40 may be performed by pumping in processed air or ultra dry air from an inlet end 300 of the bore 200, so that the ultra dry air is displaced adjacent to the exposed portion 80, to remove moisture from the coring.

In one exemplary embodiment the pumping of air step 40 may include the processing of ambient air step 35. In this embodiment the pumping step 40 may be performed in two stages, first the ambient air may be processed 35 at the time in which it may be pumped in by using a first pumping step 42. The first pumping step 42 may include the use of an air dryer. In one exemplary embodiment, the air dryer may be a desiccant.

This first step 42 may be followed by a second step 44. In one exemplary embodiment the second pumping step 44 may include the use of a mid pressure, high volume pump. The first pumping step 42 may be used to dry the air in and around the exposed portion 80. The second pumping step 44 may be used to pump air into the exposed portion 80. In one exemplary embodiment, the first pumping step 42 may be used to dry the air to create and ultra dry air 90. The second pumping step 44 may include capturing 110 the ultra dry air 90, and then displacing the ultra dry air 90 into the exposed portion 80.

In one exemplary embodiment, the penetrating step 50 may include penetrating the exposed portion 80 with a first sealant 100 or epoxy. The filling step 60 may include the filling 60 of the exposed portion 80 with a second sealant 100' or epoxy.

Figure 3:
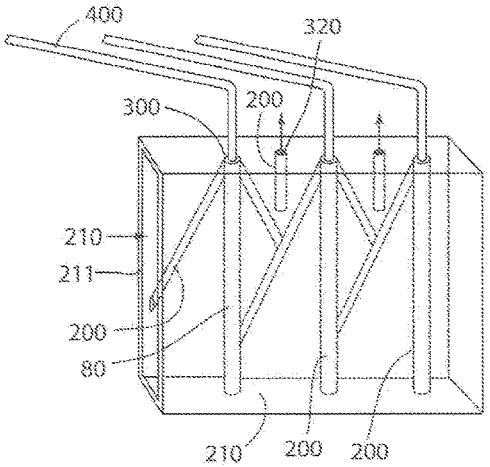
FIG. 3 shows a section of a stringer 210.
Figure 4:
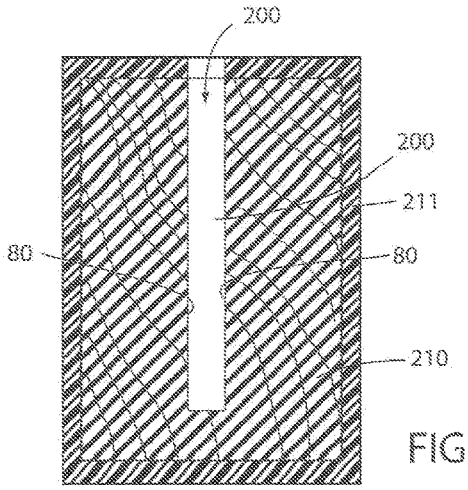
FIG. 4 shows a cross-section of a stringer 210, with outer fiberglass skin 211.

FIG. 3 illustrates one method of using the system, including the forming 30 of a plurality of bores 200 within a stringer 210. The bores 200 are capable of having an inlet end 300, and an outlet end 320. The inlet end 300 may receive air from an external source 400, such as an air pump. The outlet end 320 enables an escape or exit route for the air pumped in through the inlet end 300. As the air is displaced throughout the bores 200 adjacent the exposed portion 80, and out of the outlet end 320; the moisture is removed.

After moisture is removed, then the bores 200 can be filled with a sealant 100 or an epoxy in a filling step 60. For example, a first sealant 100 or epoxy may be used to penetrate the exposed portion 80. And a second sealant 100' or epoxy may be used to fill the bores 200.

The applicants processed air is not ambient air. The process uses ambient at its start, and process with desiccant, to create processed air, or ultra dry air, not ambient air. Low grain moisture air has 65%-75% less moisture than ambient air, which allows that air to remove more moisture, which allows the process to be faster.

A preferred embodiment of the present invention includes the process of processing air (removing moisture) and then using that processed air to dry the coring by pumping it in to the damaged area.

The applicants' process is currently used by one of the largest boat manufacturer's in the world for a number of reasons:

1. A preferred embodiment of the present invention process is able to dry coring faster than the prior art. This is possible because the applicants' process dries the air used in drying the coring. The process of the present invention uses a desiccant to reduce the moisture in the processed air by about 60% to about 70%. The percentages are averages obtained on site;

2. The applicants' process is simply less destructive than the prior art. For example, using the applicants' process, the worst case scenario is a number of ½" holes and in most cases on the exterior of boats, the holes are ¼". When the prior art process or apparatus, such as that disclosed in DeTurris is used, this vacuum process requires holes having a diameter of about 1 inch up to about and can go to 2½ inches. To repair a hole that is greater than 1 inch in diameter requires structural repair. Whereas a hole smaller than 1 inch, such the applicants process that only requires ¼ inch diameter holes, only requires cosmetic repair. Therefore, after using the applicants' process, one only needs to dry and perform cosmetic repairs. However using the process of the prior art, requires drying and performing structural repairs;

3. The applicants' process takes much less time than that of the prior art. For example, one of the applicant's was using a preferred embodiment of the present invention, and the process of A preferred embodiment of the present invention performed the complete process in two months and three weeks, at the time another boat was being dried using the prior art, and it took about seven months to complete the drying process.

The process of a preferred embodiment of the present invention is faster, costs less, and more convenient to use than the prior art.

It should be understood, of course, that the foregoing relates to exemplary embodiments of the invention and that modifications may be made without departing from the spirit and scope of the invention as set forth in the following claims.

We claim:

1. A method of removing structural weakening moisture from wood, comprising the steps of:

forming a plurality of bores of about ¼ of an inch to about ½ of an inch in diameter each, in moist wood coring to expose the moist interior of said coring;

processing ambient air to remove more than 50% of the moisture from said ambient air, thereby creating a source of drier processed air;

providing a plurality of conduits, one for each of said plurality of bores, each said conduit extending from said source of drier processed air to its respective one of said bores; and pumping or displacing said processed drier air through said conduits directly into each of said bores to dry said wood from within said bores.

2. The method of claim 1, further comprising: filling said bores with a sealant after said coring has been dried.

3. The method of claim 1, wherein said forming step comprises the drilling of bores that are spaced apart by a distance of about 8 inches.

4. The method of claim 1, wherein said processing ambient air step uses a desiccant to reduce the moisture in said processed air by about 60% to about 70%.

5. The method of claim 1, wherein said processing ambient air uses a desiccant to reduce the moisture in said processed air by more than about 50%.

6. A method of removing structural weakening moisture from wood coring of a boat, comprising the steps of:

forming a plurality of bores of about ¼ of an inch to about ½ of an inch in diameter each, in moist wood coring to expose the moist interior of said coring;

processing ambient air to remove more than 50% of the moisture from said ambient air, thereby creating a source of drier processed air;

providing a plurality of conduits, one for each of said plurality of bores, each said conduit extending from said source of drier processed air to its respective one of said bores; and pumping or displacing said processed drier air through said conduits directly into each of said bores to dry said coring from within said bores.

7. The method of claim 1, wherein said forming bores step comprises forming a plurality of bores throughout said wood.

8. The method of claim 1, wherein each of said bores has an inlet end that is capable of receiving air directly from said conduit, and an outlet end that is capable of allowing air to exit from said bores.

9. The method of claim 1, wherein said forming step is performed to create a plurality of bores that interconnect within said wood.

10. The method of claim 6, said processing ambient air step includes pumping ambient air through a drier.

11. The method of claim 6, further comprising: filling said bores with a sealant after said coring has been dried.

12. The method of claim 6, wherein said coring is covered with a polymeric outer skin, and said bores are formed through said polymeric skin and into said wood coring.

13. The method of claim 6, wherein said forming step comprises the drilling of bores that are spaced apart by a distance of about 8 inches.

14. The method of claim 6, wherein said processing ambient air step uses a desiccant to reduce the moisture in said processed air by about 60% to about 70%.

15. The method of claim 6, wherein said processing ambient air step uses a desiccant to reduce the moisture in said processed air by more than about 50%.

16. The method of claim 6, wherein said forming bores step comprises forming a plurality of bores throughout said coring.

17. The method of claim 6, wherein said coring comprises stringers, and said forming bores step comprises forming a plurality of bores throughout said stringer, wherein each of said bores has an inlet end that is capable of receiving air directly from said conduit, and an outlet end that is capable of allowing air to exit from said plurality of bores.

18. The method of claim 6, wherein said forming step is performed to create a plurality of bores that interconnect within said coring.

19. The method of claim 6, said processing ambient air step includes pumping ambient air through a drier.

20. The method of claim 19, wherein said processing ambient air step uses a desiccant to reduce the moisture in said processed air by about 60% to about 70%.

* * * * *